US007294227B2

(12) United States Patent
Bokström et al.

(10) Patent No.: US 7,294,227 B2
(45) Date of Patent: Nov. 13, 2007

(54) METHOD AND SYSTEM FOR THE TREATMENT OF PULP PRIOR TO OZONE BLEACHING

(75) Inventors: Monica Bokström, Koviand (SE); Per Åström, Kovland (SE)

(73) Assignee: Metso Paper, Inc. (FI)

( * ) Notice: Subject to any disclaimer, the term of this patent is extended or adjusted under 35 U.S.C. 154(b) by 20 days.

(21) Appl. No.: 10/497,753

(22) PCT Filed: Dec. 4, 2002

(86) PCT No.: PCT/SE02/02229

§ 371 (c)(1),
(2), (4) Date: Jan. 13, 2005

(87) PCT Pub. No.: WO03/048448

PCT Pub. Date: Jun. 12, 2003

(65) Prior Publication Data

US 2005/0121158 A1 Jun. 9, 2005

(30) Foreign Application Priority Data

Dec. 5, 2001 (SE) ..... 0104081

(51) Int. Cl.
*D21C 9/10* (2006.01)

(52) U.S. Cl. ..... 162/65; 162/9; 162/24; 162/25; 162/52; 162/90; 162/181.2; 162/236; 162/238

(58) Field of Classification Search ..... 162/24, 162/9, 25, 52, 65, 90, 181.2, 182, 183, 236, 162/238, 242, 246, 252, 254, 261, 263
See application file for complete search history.

(56) References Cited

U.S. PATENT DOCUMENTS

| | | | | |
|---|---|---|---|---|
| 4,278,496 | A | 7/1981 | Fritzvold | |
| 5,626,297 | A * | 5/1997 | Carlsmith et al. | 241/57 |
| 6,210,532 | B1 * | 4/2001 | Shackford | 162/238 |
| 6,989,078 | B1 * | 1/2006 | Bokstrom et al. | 162/236 |

FOREIGN PATENT DOCUMENTS

| | | |
|---|---|---|
| WO | WO-96/05365 A1 | 2/1996 |
| WO | WO-00/77296 A1 | 12/2000 |

* cited by examiner

*Primary Examiner*—Mark Halpern
(74) *Attorney, Agent, or Firm*—Lerner, David, Littenberg, Krumholz & Mentlik, LLP

(57) ABSTRACT

A system for treating pulp comprises a dewatering device (2) for dewatering the pulp to a fiber concentration of at least 20%, a closed pulp-shredding vessel (16) for shredding the dewatered pulp, and an outlet pipe (22) from the pulp-shredding vessel. A transport screw (18) is arranged in the outlet pipe for transporting the shredded pulp from the pulp-shredding vessel through the outlet pipe through a reactor vessel (6) for bleaching the shredded pulp through reaction with ozone gas. The outlet pipe (22) is designed with a heightened roof portion (27), so that an upper gas space (29) free from pulp is formed in the outlet pipe between the roof portion and the transport screw. A flow-restraining member in the form of a partition wall (31) is arranged in the upper gas space in the outlet pipe for restraining the gas flow through the gas space, whereby the pumping action of the transport screw in the outlet pipe is decreased.

6 Claims, 1 Drawing Sheet

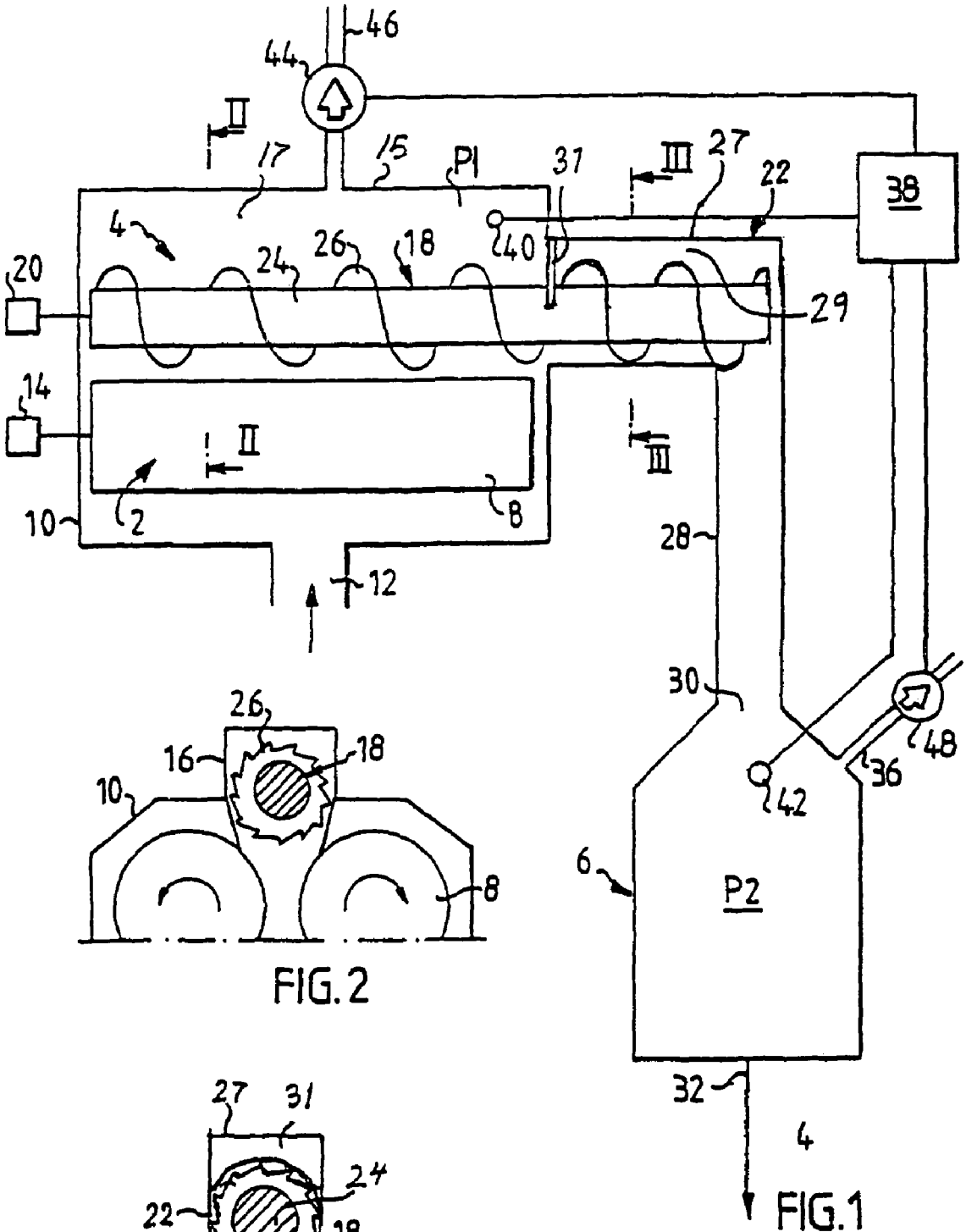
FIG. 1
FIG. 2
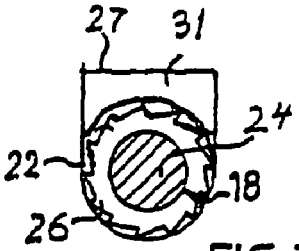
FIG. 3

METHOD AND SYSTEM FOR THE TREATMENT OF PULP PRIOR TO OZONE BLEACHING

CROSS-REFERENCE TO RELATED APPLICATIONS

The present application is a national phase entry under 35 U.S.C. § 371 of International Application No. PCT/SE02/02229 filed Dec. 4, 2002, published in English, which claims priority from Swedish application number 0104081-5 filed Dec. 5, 2001, all of which are incorporated herein by reference.

The present invention relates to a method for treatment of pulp, in which the pulp is dewatered to a fiber concentration of at least 20% dryness, the dewatered pulp is shredded in a closed pulp-shredding vessel, the shredded pulp is transported from the pulp-shredding vessel through an outlet pipe by means of a transport screw therein directly to a reactor vessel via a conduit which is gastight against the environment, the interior of the conduit communicating with the interior of the outlet pipe and with the interior of the reactor vessel, and the shredded pulp is bleached in the reactor vessel through reaction with ozone gas.

The invention also relates to a system for treatment of pulp, comprising a dewatering device for dewatering the pulp to a fiber concentration of at least 20% dryness, a closed pulp-shredding vessel in which the dewatered pulp is shredded, an outlet pipe from the pulp-shredding vessel, and a transport screw arranged in the outlet pipe for transportation of the shredded pulp from the pulp-shredding vessel through the outlet pipe. The system further comprises a reactor vessel for bleaching the shredded pulp through reaction with ozone gas, and a conduit which is gastight against the environment and which connects the outlet pipe of the pulp-shredding vessel gas tightly to the reactor vessel, so that the interior of the outlet pipe directly communicates with the interior of the reactor vessel via the interior of the conduit.

A method and a system of these kinds are known from SE 514416 C2. In accordance with the known method the shredded pulp is transported, without being compressed, continuously out of the pulp-shredding vessel via the outlet pipe, so that the outlet pipe is kept filled with passing pulp. From the outlet pipe the shredded pulp is directly transported to the reactor vessel through the gastight conduit, and at the same time the gas pressure in the pulp-shredding vessel is kept higher than the gas pressure in the reactor vessel. The combination of the two measures—(1) keeping the outlet pipe filled with passing shredded non-compressed pulp, and—(2) keeping the gas pressure in the pulp-shredding vessel higher than that in the reactor vessel, has proved to be sufficient to prevent ozone gas from leaking from the reactor vessel upstream out to the environment.

Traditionally, the shredded pulp is transported by means of a plug screw from the pulp-shredding vessel to a fluffer, in which the pulp is fluffed, and then the fluffed pulp is bleached in the reactor vessel, see for example WO 9605365 A1. The function of the plug screw is to compress the shredded pulp to a plug forming a gas lock preventing ozone gas from leaking from the reaction vessel upstream in the system to the environment. The function of the fluffer is to fluff up the compressed pulp leaving the pulp screw, so that the pulp gets a large specific surface, which facilitates the reaction of the ozone gas with the lignin of the pulp. Thus, the pulp entering the reactor vessel has to be fluffed, in order to obtain high ozone utilization and a good bleaching selectivity. With the method and system according to SE 514416 C2 it has been possible to eliminate the need for a plug screw and a fluffer.

However, when using the method and system according to SE 514416 C2 the problem has arisen that the transport screw acts as a pump in the outlet pipe filled with shredded pulp, which results in that a certain amount of air is pumped from the pulp-shredding vessel to the reactor vessel. Thus, in the reactor vessel the air is mixed with the ozone gas. Because of the nitrogen content of the air the surplus of ozone gas will get a smaller oxygen content, which makes the surplus gas less valuable. For example, the surplus gas could be used for oxygen delignification if it had a sufficient content of oxygen.

An object of the present invention is to improve the known method according to SE 514416 C2, so that the amount of air mixing with the ozone gas is substantially reduced.

This object is obtained by the method initially stated characterized by transporting the shredded pulp by a transport screw through the outlet pipe in such a manner that an upper gas space is formed in the outlet pipe between the pulp-shredding vessel and the gastight conduit, and restraining the gas flow flowing through the upper gas space between the pulp-shredding vessel and the gastight conduit. This reduces the pumping action of the transport screw, which results in that only an insignificant amount of air can leak to the reactor vessel.

According to a preferred embodiment of the invention the transport screw extends in the pulp-shredding vessel and shreds the pulp therein in such a manner that a further upper gas space is formed in the pulp-shredding vessel above the transport screw. This further reduces the pumping action of the transport screw.

Preferably, a transport screw shreds the pulp in the pulp-shredding vessel by at least one toothed transport thread.

The gas pressure in the pulp-shredding vessel is advantageously kept lower than the gas pressure in the reactor vessel, which further reduces leakage of air to the reactor vessel. Preferably, the gas pressure in the pulp-shredding vessel and the gas pressure in the reactor vessel is regulated to predetermined values, so that the difference between these gas pressures suitably is in the range of 0.1-1.5 kPa. The gas pressures in the pulp-shredding vessel and the reactor vessel are advantageously kept below the ambient atmospheric pressure.

For example, the gas under-pressure in the pulp-shredding vessel may be from 0.1 to 1.5 kPa while the gas under-pressure in the reactor vessel can be between 0.01 to 0.4 kPa.

The shredded pulp in the gas pip conduit is suitably transported by gravity.

A further object of the present invention is to improve the known system according to SE 514416 C2, so that the amount of air mixed with the ozone gas is substantially reduced during operation of the system.

This object is obtained by the system initially stated characterized in that the outlet pipe is designed with a heightened roof portion, so that an upper gas space free from pulp is formed in the outlet pipe between the roof portion and the transport screw, which gas space extends between the pulp-shredding vessel and the gas pipe conduit, and a flow restraining member arranged in the upper gas space in the outlet pipe for restraining the gas flow through the gas space.

According to a preferred embodiment of the system according to the invention, the transport screw extends in the pulp-shredding vessel and the pulp-shredding vessel is designed with a heightened roof portion, so that an additional upper gas space free from pulp is formed in the pulp-shredding vessel above the transport screw.

The flow-restraining member preferably comprises a partition wall extending in the gas space perpendicular to the outlet pipe. The partition wall is suitably situated at the end of the outlet pipe at which the shredded pulp enters the outlet pipe. Alternatively, however, the partition wall may be placed in another location in the outlet pipe.

The system advantageously comprises a pressure regulation device for maintaining a gas pressure in the pulp-shredding vessel, which is lower than the gas pressure in the reactor vessel. The pressure regulation device regulates the gas pressure in the pulp-shredding vessel and the gas pressure in the reactor vessel to predetermine values. Preferably, the pressure regulation device comprises a first fan with a controllable capacity arranged in a gas outlet in the pulp-shredding vessel for evacuation of gas therefrom, a second fan with a controllable capacity arranged in a gas outlet in the reactor vessel for evacuation of gas therefrom, a first pressure sensor for sensing the gas pressure in the pulp-shredding vessel, a second pressure sensor for sensing the gas pressure in the reactor vessel, and a control unit which controls the capacity of a first and second, respectively, fan in response to the first and second, respectively, pressure sensor.

The invention is described in more detail in the following with reference to the accompanying drawing, in which FIG. 1 schematically shows an example of the system according to the present invention, and FIG. 2 and FIG. 3, respectively, is a cross section along the line II-II and III-III, respectively, in FIG. 1.

The drawing shows a system for treatment of pulp comprising a dewatering device 2, a pulp-shredding device 4 and a reactor vessel 6 for bleaching the pulp through reaction with ozone gas. The dewatering device 2 comprises two pressure rolls 8, which are arranged to counter rotate in a housing 10, and an inlet 12 for pulp to be dewatered in the lower part of the housing 10. A motor 14 provides for the rotation of the pressure rolls 8. An elongated closed pulp-shredding vessel 16 extends along the pressure rolls 8 above these. In the pulp-shredding vessel 16 a transport screw 18 extends in parallel in the pressure rolls 8. The pulp-shredding vessel 16 is designed with a heighten roof portion 15, so that an upper gas space 17 free from pulp is formed in the pulp-shredding vessel 16 above the transport screw 18. Another motor 20 is adapted to rotate the transport screw 18. The pulp-shredding vessel 16 has a lower elongated inlet for pulp that has been dewatered by the pressure rolls 8, see FIG. 2 and an outlet pipe 22, through which the transport screw 18 extends, for dewatered and shredded pulp.

The transport screw 18 has a core 24 with a constant diameter and a toothed transport thread 26 with a constant pitch and diameter. Alternatively, the transport screw 18 may have more than one transport thread 26. The part of the transport thread 26 extending in the outlet pipe 22 may alternatively not be toothed.

Also the outlet pipe 22 is designed with a heightened roof portion 27, so that an upper gas space 29 free from pulp is form in the outlet pipe 22 between the roof portion 27 and the transport screw 18. The lower part of the interior of the outlet pipe 22 has a semi-circular cross-section and fits the transport screw 18. A flow-restraining member in the form of a partition wall 31 extends in the gas space 29 perpendicular to the outlet pipe 22 and is situated at the end of the outlet pipe 22 at which the shredded pulp enters the outlet pipe 22. The partition wall 31 is formed with a lower semi-circular recess that fits the transport screw 18.

A vertical gas tight conduit 28 connects the outlet pipe 22 gas tightly to an upper inlet 30 in the reactor vessel 6, so that the interior of the outlet pipe 22 directly communicates with the interior of the reactor vessel 6 via the interior of the conduit 28. The reactor vessel 6 has a lower outlet conduit 32 for discharging bleached pulp, and an upper outlet conduit 36 for evacuation of gas. There is also means, not shown, for supplying ozone gas to the interior of the reactor vessel 6.

A control unit 38 is by signal lines connected to a pressure sensor 40 for sensing the gas pressure P1 in the pulp-shredding vessel 16 and to a pressure sensor 42 for sensing the gas pressure P2 in the reactor vessel 6. The control unit 38 is by further signal lines also connected to a fan 44 with a controllable capacity situated in an upper outlet conduit 46 from the pulp-shredding vessel 16, and to another fan 48 likewise with controllable capacity situated in the upper outlet conduit 36 of the reactor vessel 6.

During operation, a pulp suspension is pumped via the inlet 12 of the dewatering device 2 to the pressure rolls 8, which are counter rotated by the motor 14, the rotational direction of the pressure rolls is indicated by arrows in FIG. 3, so that the pulp during dewatering is pulled between the pressure rolls 8 up to the inlet of the pulp-shredding vessel 16. When entering the inlet of the pulp-shredding vessel 16 the dewatered pulp has a fiber concentration of 20-50% dryness. In the pulp-shredding vessel 16 the toothed transport thread 26 of the transport screw 18, which is rotated by the motor 20, shreds the pulp. During the pulp shredding operation, the gas space 17 is free from pulp. Depending on the desired result the toothing of the transport thread 26 may be designed so that a relatively coarse or fine shredding of the pulp is obtained.

The transport screw 18 feeds the shredded pulp through the outlet pipe 22, without compressing the pulp and without filling the outlet pipe 22 completely (the upper gas space 29 of the outlet pipe 22 is not filled), whereby the pumping action of the transport screw is decreased. The partition wall 31 restrains the gas flow between the pulp-shredding vessel 16 and the reactor vessel 6. From the outlet pipe 22 the shredded pulp falls through the vertical conduit 28 to the reactor vessel 6, where the pulp is bleached through reaction with ozone gas. Finally, the bleached pulp is taken out of the reactor vessel 6 via the lower outlet conduit 32.

The control unit 38 controls the capacity of the fans 44 and 48, for example through speed control, in response to the pressure sensors 40 and 42, so that the gas pressure P1 in the pulp-shredding vessel 16 is kept lower than the gas pressure P2 in the reactor vessel 6. Hereby, the air in the pulp-shredding vessel 16 is efficiently prevented from passing to the reactor vessel. The control unit 38 maintains both the gas pressure P1 and gas pressure P2 below the ambient atmospheric pressure. Suitably, the control unit 38 maintains the gas pressure P1 in the range of 0.1-1.5 kPa atu and the gas pressure P2 in the range of 0.01-0.04 kPa atu at the same time as the control unit 38 regulates the pressure difference between the gas pressure P1 and P2 towards a predetermined value chosen in the range of 0.1-1.3 kPa.

The invention claimed is:

1. A method of treatment of pulp, comprising dewatering pulp to a fiber concentration of at least 20% dryness, shredding said dewatered pulp in a closed pulp-shredding vessel, transporting said shredded pulp from said pulp-shredding vessel through an outlet pipe to a gastight conduit of a reactor vessel by a transport screw which communicates with an interior of said outlet pipe and an interior of said reactor vessel, bleaching said shredded pulp in said reactor vessel through reaction with ozone gas, transporting said shredded pulp by said transport screw through said outlet pipe such that an upper gas space is formed in said outlet pipe between said pulp-shredding vessel and said gastight conduit, restraining a gas flow through said upper gas space between said pulp-shredding vessel and said gastight conduit, and maintaining a gas pressure in said pulp-shredding vessel lower than a gas pressure in said reactor vessel.

2. The method of claim 1, wherein said transport screw extends in said pulp-shredding vessel and shreds said pulp such that an additional upper gas space is formed in said pulp-shredding vessel above said transport screw.

3. The method of claim 1, comprising regulating said gas pressure in said pulp-shredding vessel and said gas pressure in said reactor vessel to predetermined values.

4. The method of claim 3, comprising maintaining said gas pressures in said pulp-shredding vessel and said reactor vessel below an ambient atmospheric pressure.

5. The method of claim 1, comprising transporting said shredded pulp in said gastight conduit by gravity.

6. The method of claim 1, comprising shredding said pulp with said transport screw by at least one toothed transport thread.

* * * * *

UNITED STATES PATENT AND TRADEMARK OFFICE

CERTIFICATE OF CORRECTION

PATENT NO. : 7,294,227 B2
APPLICATION NO. : 10/497753
DATED : November 13, 2007
INVENTOR(S) : Monica Bokström and Per Åström It is certified that error appears in the above-identified patent and that said Letters Patent is hereby corrected as shown below:

On the Title Page Item (75) replace “Koviand” with --Kovland--.

Signed and Sealed this

Thirtieth Day of September, 2008

JON W. DUDAS
*Director of the United States Patent and Trademark Office*